United States Patent [19]

Braun et al.

[11] Patent Number: 4,921,307

[45] Date of Patent: May 1, 1990

[54] MINING APPARATUS FOR MECHANIZED BREAKING-DOWN OF MINERAL MATERIALS, PARTICULARLY COAL, IN UNDERGROUND MINING OPERATIONS

[75] Inventors: Gert Braun; Ernst Braun, both of Essen-Heisingen, Fed. Rep. of Germany

[73] Assignee: Halbach & Braun Industrieanlagen, Wuppertal, Fed. Rep. of Germany

[21] Appl. No.: 268,088

[22] Filed: Nov. 7, 1988

[30] Foreign Application Priority Data

Nov. 6, 1987 [DE] Fed. Rep. of Germany ..... 3737664

[51] Int. Cl.[5] ..... E21C 27/34; E21C 29/16

[52] U.S. Cl. ..... 299/34; 74/665 B; 299/48

[58] Field of Search ..... 299/1, 34, 47, 48, 42; 74/661, 675, 665 A, 665 B, 665 P

[56] References Cited

U.S. PATENT DOCUMENTS 2,970,442 2/1961 Taylor ..... 74/665 B X
3,721,378 3/1973 Hughes et al. ..... 299/34

FOREIGN PATENT DOCUMENTS 612084 6/1978 U.S.S.R. ..... 74/665 B
649843 2/1979 U.S.S.R. ..... 299/34
1050105 12/1966 United Kingdom ..... 299/1

*Primary Examiner*—Jerome W. Massie, IV
*Assistant Examiner*—David J. Bagnell
*Attorney, Agent, or Firm*—Toren, McGeady & Associates

[57] ABSTRACT

A mining apparatus for the mechanized breaking-down of mineral raw materials, particularly coal, in underground mining operation includes at least one endless chain and chain wheels for the endless chain. A main drived is provided for one of the chain wheels and an auxiliary drive is provided for the other chain wheel. The main drive and the auxiliary drive each has a transmission unit including main transmission stage, initial transmission stage, coupling and drive motor. A superposed motor in the form of a controllable electric motor having small power acts in connection with a worm gear transmission on the superposed input of the superposed transmission unit. Synchronous running of the main drive and the auxiliary drive or the drive motors thereof is achieved by a unilateral drive control. This results in a uniform power and load input independently of the wear of the chain and chain wheels.

9 Claims, 1 Drawing Sheet

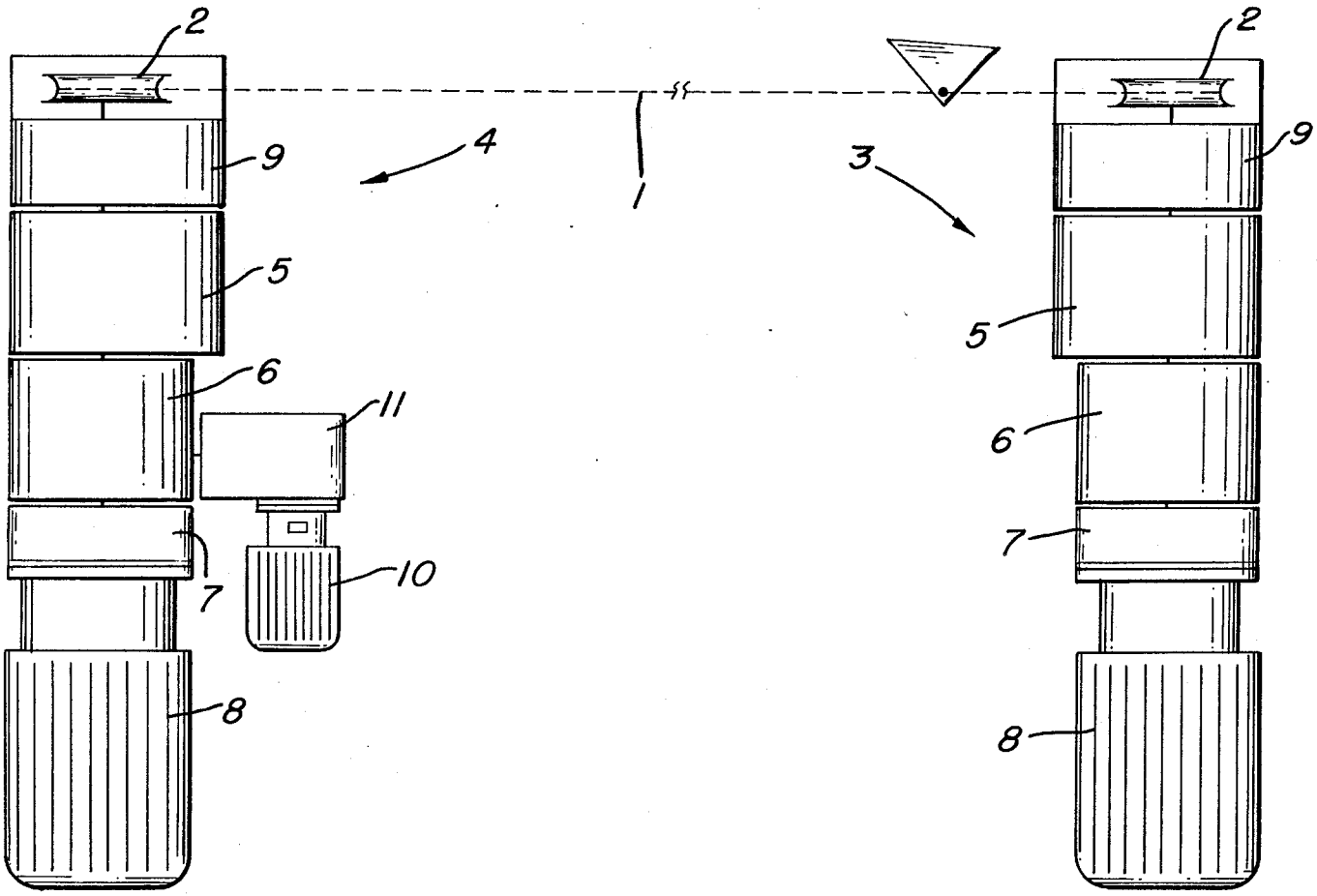
2
9
5
6
7
8
3
1
4
11
10

MINING APPARATUS FOR MECHANIZED BREAKING-DOWN OF MINERAL MATERIALS, PARTICULARLY COAL, IN UNDERGROUND MINING OPERATIONS

BACKGROUND OF THE INVENTION

1. Field of the Invention

The present invention relates to a mining apparatus for the mechanized breaking-down of mineral raw materials, particularly coal, in underground mining operations. The mining apparatus includes at least one revolving endless chain and chain wheels for the endless chain at the revolving ends of the chain. A main drive is provided for one of the chain wheels and an auxiliary drive is provided for the other chain wheel. The main drive and the auxiliary drive each have a transmission unit including main transmission stage, initial transmission stage, coupling and drive motor. The mining apparatus is preferably a combined planing and conveying apparatus and, consequently, the endless chain is either a planing chain or a conveying chain.

2. Description of the Related Art

In mining apparatus of the above-described type it is desired that the drive motors of main drive and auxiliary drive run synchronously because only a synchronous running ensures a uniform load or maximum power of main drive and auxiliary drive. However, the drive motors do not run synchronously if the chain and the chain wheels are worn. This is because after a certain duration of operation, the endless chain runs on the chain wheels which have different pitch circles due to the wear. Thus, the endless chain runs on the chain wheels with different speeds. As a result, the load on the drive motor for the chain wheel on which the chain runs with the greater pitch circle may increase to such an extent that the other drive motor finally is pulled along in the manner of a generator. Accordingly, the other drive, i.e., either the main drive or the auxiliary drive, no longer operates as a drive as a result of the fact that the drives no longer run synchronously.

In order to avoid the resulting overload of the main drive or of the auxiliary drive, a drive control has become known by means of which the drive motors, generally asynchronous motors, are controlled directly. However, the control of drive motors with a power of up to 300 kW is cumbersome with respect to plant engineering, is expensive and, moreover, requires substantial space. This is particularly troublesome because of the narrow space available underground.

For this reason, frequently a different type of drive control is used. In this type of control, hydraulically driven and controlled motors act through auxiliary or support transmission units on the initial transmission stage of the main drive as well as of the auxiliary drive. Consequently, it is always necessary to use two special transmission units and two hydraulic motors. In addition, it is necessary to supply the hydraulic motors through hydraulic hoses. These measures also require substantial space and are expensive. Moreover, they are susceptible to trouble because, in view of the difficult work conditions prevailing in underground mining operations, it is possible that the hydraulic hoses are damaged. Moreover, hydraulic hoses can only be controlled downwardly and, when the hydraulic control fails, the entire mining apparatus can no longer be operated.

It is, therefore, the primary object of the present invention to provide a mining apparatus of the above-described type which avoids the disadvantages described above.

Specifically, it is the object of the present invention to provide a mining apparatus for the mechanized mining of mineral raw materials, particularly coal, in underground mining operations, which is of compact construction, is not expensive and includes a safely operating drive control for synchronous operation.

SUMMARY OF THE INVENTION

In accordance with the present invention, in a mining apparatus of the above-described type, the initial transmission stage of the auxiliary drive or of the main drive is a superposed or overriding transmission or gear unit and a superposed motor in the form of a controllable electric motor having small power acts on the superposed input of this superposed transmission unit.

The above-described features of the present invention make it possible that only a unilateral control is required, i.e. a control of the auxiliary drive or of the main drive, in dependence upon the rate of rotation of the motor of the main drive or of the auxiliary drive. Thus, it is only necessary to use a single special transmission unit, i.e., an superposed transmission unit, and a single superposed motor, i.e., an electric motor having a small power. Nevertheless, synchronous running of the two drive motors is ensured. In the mining apparatus according to the invention, the drive motors are also preferably asynchronous motors. This results with respect to both chain wheels in a uniform power input of the two drive motors and, thus, in a uniform distribution of the load on the chain wheels or on the endless chain.

Compared to the known drive control by means of hydraulic motors, the space requirement and the expenses are cut in half and the operational efficiency is increased because the supply of current to the single electric motor is much less problematic than the supply of hydraulic medium to the two hydraulic motors.

In addition, in the mining apparatus according to the present invention, the rate of rotation of the respective motor can be controlled upwardly or downwardly as synchronization is carried out. Also, the drive control can be reduced to the auxiliary drive at which usually more space is available than at the main drive in the transition area from the longwall to the drift.

Finally, if the control fails, the mining apparatus can still be further operated in the conventional manner. Moreover, practically no heat is added to the air when the drive control according to the present invention is used.

The above may be considered the major advantages of the present invention.

Additional features of the present invention are discussed below.

In accordance with a proposal of the invention with independent significance, the electric motor acts on the superposed transmission unit with a predetermined superposed rate of rotation when the chain wheel is driven with a rated rate of rotation. Within the range of the rate of rotation defined as a result, at least the downward control from an increased rate of rotation or vice versa to the respective rate of rotation of the motor of the main drive or of the auxiliary drive takes place. The rated rate of rotation is the initial rate of rotation when the endless chain and the chain wheels are not yet worn. Accordingly, the predetermined initial or rated rate of rotation takes into consideration from the beginning the superposed rate of rotation provided by the superposed or electric motor. This makes it substantially simpler to control downwardly an increased rate of rotation and to control upwardly a low rate of rotation while the electric motor continues to run. The range of control may be ±5 rpm in relation to the rate of rotation of ±5% in relation to the power of the electric motor.

In accordance with a preferred feature of the invention, an auxiliary transmission unit in the form of a worm gear transmission is arranged between the superposed transmission unit constructed as a planetary gear transmission and the electric motor. The worm gear transmission serves as a lock against loads from the drive system, so that the electric motor is protected particularly against impact-like loads from the drive system. The electric motor advantageously has a power of 10 to 20 kW, preferably 15 kW and is frequency-controlled in dependence upon the rate of rotation of the main drive or the auxiliary drive.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

BRIEF DESCRIPTION OF THE DRAWING

In the drawing:

The single FIGURE of the drawing schematically shows a mining apparatus with a drive control according to the present invention.

DESCRIPTION OF THE PREFERRED EMBODIMENT

The drawing specifically shows a mining apparatus for the mechanized breaking-down of mineral raw materials, particularly coal, in underground mining operations. The apparatus includes a revolving endless chain 1 and chain wheels 2 for the endless chain which revolves at its ends at the chain wheels 2. A main drive 3 is provided for one of the chain wheels and an auxiliary drive 4 is provided for the other chain wheel. The drives 3 and 4 each have a transmission unit composed of main transmission stage 5 and initial transmission stage 6, coupling 7 and drive motor 8.

In the illustrated embodiment, the mining apparatus is a planing unit and, thus, the endless chain 1 is a planing chain. The drive motors 8 are asynchronous motors. Between each main transmission stage 5 and each chain wheel 2 is arranged a planing drive 9 with a star-type bolt coupling which can separate the rotating masses directly at the chain wheel 2. Only the initial transmission stage 6 of the auxiliary drive 4 is a superposed transmission unit. A superposed motor in the form of a controllable electric motor 10 with a small power acts on the superposed input of only this superposed transmission unit 6.

An auxiliary transmission unit 11 in the form of a worm gear transmission is arranged between the superposed transmission unit 6 in the form of a planetary gear transmission and the electric motor 10. The electric motor 10 has a power of 10 to 20 kW, preferably 15 kW. The electric motor 10 is frequency-controlled in dependence upon the rate of rotation of the motor of the main drive. The control circuit is not illustrated.

While a specific embodiment of the invention has been shown and described in detail to illustrate the application of the inventive principles, it will be understood that the invention may be embodied otherwise without departing from such principles.

We claim:

1. In a mining apparatus for the mechanized breaking-down of mineral raw materials, particularly coal, in underground mining operations, the mining apparatus including at least one revolving endless chain and chain wheels for the endless chain at the revolving ends of the chain, a main drive being provided for one of the chain wheels and an auxiliary drive being provided for the other chain wheel, the main drive and the auxiliary drive each having a transmission unit including a main transmission stage, an initial transmission stage, a coupling connected to the transmission and a improvement comprising the initial transmission stage of one of the auxiliary drive and of the main drive being a superposed transmission unit, the superposed transmisison unit having a superposed input, a controllable superposed motor having small power being connected to the superposed input of the superposed transmission unit.

2. The mining apparatus according to claim 1, wherein the superposed motor is an electric motor.

3. The mining apparatus according to claim 2, wherein the electric motor is configured to act on the transmission unit with a predetermined superposed rate of rotation when the chain wheel is driven with a rated rate of rotation, and wherein, within the thus defined range of rate of rotation, at least the downward control from an increased rate of rotation to the respective rate of rotation of a motor of one of the main drive and of the auxiliary drive can be effected.

4. The mining apparatus according to claim 2, wherein the electric motor is configured to act on the superposed transmission unit with a predetermined superposed rate of rotation when the chain wheel is driven with a rated rate of rotation, and wherein, in the thus defined range of rate of rotation, at least the upward control from a low rate of rotation to the respective rate of rotation of a motor of one of the main drive and of the auxiliary drive can be effected.

5. The mining apparatus according to claim 2, wherein an auxiliary transmission unit is arranged between the superposed transmission unit and the electric motor.

6. The mining apparatus according to claim 5, wherein the auxiliary transmission unit is a worm gear transmission unit.

7. The mining apparatus according to claim 5, wherein the superposed transmission unit is a planetary gear transmission.

8. The mining apparatus according to claim 2, wherein the electric motor has a power of 10–20 kW and is frequency-controlled in dependence upon the rate of rotation of one of the main drive and the auxiliary drive.

9. The mining apparatus according to claim 8, wherein the electric motor has a power of 15 kW.

* * * * *